United States Patent [19]

Ueno et al.

[11] 4,287,935

[45] Sep. 8, 1981

[54] VERTICAL DIE CASTING MACHINE

[75] Inventors: Toyoaki Ueno, Yamaguchi; Masashi Uchida, Ube, both of Japan

[73] Assignee: Ube Industries, Ltd., Yamaguchi, Japan

[21] Appl. No.: 162,804

[22] Filed: Jun. 25, 1980

[30] Foreign Application Priority Data

Jul. 26, 1979 [JP] Japan ..... 54-94237
Jul. 31, 1979 [JP] Japan ..... 54-96789

[51] Int. Cl.[3] ..... B22D 17/12
[52] U.S. Cl. ..... 164/314; 164/312
[58] Field of Search ..... 164/312, 314, 315, 303, 164/113

[56] References Cited

U.S. PATENT DOCUMENTS 3,826,302 7/1974 Wunder ..... 164/312
4,088,178 5/1978 Ueno et al. ..... 164/314

*Primary Examiner*—Robert D. Baldwin
*Attorney, Agent, or Firm*—Burgess, Ryan and Wayne

[57] ABSTRACT

A vertical die casting machine comprising: a casting cylinder, pivotably mounted to a base, for activating a piston extension slidably fitted in a casting sleeve, and; a hollow block having an upper end connected to the casting sleeve and having a bore reduced at a lower end thereof through which bore the piston extension extends into the block. The block is forced to move by a ram cylinder relative to the casting cylinder. The piston extension has a radial extension in the block designed so that an engagement of the radial extension with the reduced bore end of the block causes a positional relationship between the casting sleeve and the piston extension to be maintained constant during an axial downward movement of the piston extension driven by the casting cylinder and during an axial upward movement driven by the ram cylinder.

10 Claims, 3 Drawing Figures

VERTICAL DIE CASTING MACHINE

BACKGROUND OF THE INVENTION

The present invention relates to a vertical die casting machine, provided with a tilting device, in which machine a molten metal in a casting sleeve is injected by an injection plunger into a die formed by stationary and movable molds, and the molten metal is poured into the casting sleeve while the sleeve is spaced apart from the stationary mold.

One such machine is disclosed in U.S. Pat. No. 4,088,178 of which the inventors are the same as those of the present invention. In such a machine, the casting sleeve and the injection plunger are designed so that they can be moved relative to the stationary mold by different driving sources. This driving system is apt to raise a problem in that the positional relationship between the injection plunger and the casting sleeve is changed and thus the space for the molten metal in the sleeve, defined by the sleeve and plunger, is changed in the steps of: pouring the molten metal into the sleeve from above the sleeve; moving the sleeve and plunger with the molten metal toward the stationary mold; and of contacting the sleeve with the stationary mold. This change results in variations of the axial length of the space and thus of the liquid level of the molten metal in the sleeve. Accordingly, there is the disadvantageous possibility that the molten metal may be scattered and agitated. Furthermore, when the molten metal is moved considerably within the sleeve, it is inclined to be cooled and readily oxidized. In some cases, only the sleeve is moved upward and the plunger is disengaged from the sleeve, causing the disadvantageous possibility of dropping the molten metal.

In the conventional machine, the injection plunger is actuated by a hydraulic cylinder holding the casting sleeve, and while the sleeve is released from stationary mold, the cylinder is tilted, together with the sleeve and the plunger, from a normal vertical position to an inclined position by a tilting device. After the sleeve receives the molten metal at the inclined position, the cylinder is returned together with the sleeve and plunger to the normal vertical position by the tilting device. The tilting device comprises a hydraulic cylinder for actuating a piston rod. The tilting cylinder is pivotally mounted at its end to a stationary base and the piston rod is pivotally mounted to the injection cylinder. In such an arrangement of the tilting device, there is a problem in that the sleeve is forced to stop suddenly at both the normal vertical position and the inclined position and to move rapidly between the two positions. Such motions of the sleeve cause the molten metal in the sleeve to be agitated, and causing the same disadvantageous possibilities as those mentioned above, that is, the scattering and of dropping of the molten metal.

SUMMARY OF THE INVENTION

Accordingly, it is an object of the present invention to provide an improved vertical die casting machine in which the axial length of the space, defined by the casting sleeve and the injection plunger for receiving the molten metal, is maintained constant and thus to eliminate the above-mentioned disadvantages.

Another object of the present invention is to provide a vertical die casting machine provided with an improved tilting device which is to prevent the molten metal poured in the casting sleeve from being agitated during the movement of the sleeve between the normal vertical position and the inclined position and thus to eliminate the above-mentioned defects.

According to the present invention, there is provided a vertical die casting machine comprising: a stationary platen; a stationary mold secured to the stationary platen, which defines, with a movable mold, a die cavity; a casting sleeve having an upper end for abutting against the stationary mold from below the stationary mold; a plunger slidably disposed in the casting sleeve, the plunger having a plunger tip which defines, with the casting sleeve, a space in the casting sleeve, in which space a molten metal to be injected by the plunger into said die cavity is received; a hollow block having an axial bore, a lower end portion of the casting sleeve being connected to an upper portion of the block, the plunger extending axially downwardly in the bore of the block, the bore of the block being restricted in a lower portion of the block, and; a casting hydraulic cylinder, mounted to the stationary platen, for actuating a casting piston rod. The casting piston rod is connected to a lower end of the plunger to form, together with the plunger, a piston extension. The block is mounted to the casting cylinder for an axial movement. The piston extension has, within the bore of the block, a radial projection, whereby the lower portion of the block serves as a stopper against the projection when the casting piston rod moves downwardly and the projection serves as a stopper against the lower portion of the block when the block moves upwardly, so that an axial length of the space for the molten metal is maintained constant regardless of the axial movements of the casting plunger and the casting sleeve.

The block is mounted for an axial movement to the casting cylinder by means of a hydraulic ram cylinder. Preferably, a ram constituting the ram cylinder is connected to an upper end of the casting cylinder, while a cylinder constituting the ram cylinder is integrated with the block. The casting cylinder has upper and lower chambers for a hydraulic pressure oil separated by the casting piston rod and is provided with means for releasing the hydraulic pressure from both chambers when the ram cylinder is actuated to force the block to move upwardly together with the casting sleeve, whereby the casting plunger is lifted up by only the block.

Preferably, the casting cylinder is pivotally mounted to the stationary platen so that it is allowed to move from a vertical position to an inclined position when the casting sleeve is in a lower position where the upper abutting end of the casting sleeve is spaced apart and downwardly from the stationary mold. A tilting device is provided for actuating the casting cylinder, while the casting sleeve is located at the lower position, so that the casting sleeve together with the casting cylinder is rotated from the vertical position to the inclined position where the molten metal is poured into the space defined by the casting sleeve and the plunger tip, and so that the casting sleeve at the inclined position is returned to the vertical position.

The tilting device comprises: a hydraulic cylinder for actuating a tilting piston, having a pair of upper and lower partial cylinders mounted to the stationary platen in such arrangement that they are spaced apart from each other in a vertical direction, the tilting piston having upper and lower portions axially slidably fitted in the upper and lower partial cylinders, respectively, and having an intermediate portion forming an axial rack gear; a pinion gear rotatably mounted to the stationary platen in an engagement with the rack gear, and; a linkage connected to the pinion gear at its one end and to the casting cylinder at the other end. In this arrangement, while the upper partial cylinder is released from a hydraulic pressure, the lower partial cylinder is supplied with the hydraulic pressure oil so that the tilting piston rod is forced to move upwardly, and while the lower partial cylinder is released from the hydraulic pressure, the upper partial cylinder is supplied with the hydraulic oil under pressure so that the tilting piston rod is forced to move downwardly.

Preferably, the upper and lower partial cylinders are provided with upper and lower conduit means fixed at the upper end of the upper partial cylinder and at the lower end of the lower partial cylinder, respectively. Each conduit means extends axially in the respective partial cylinder, and it has a closed inner end and an open outer end for introducing and discharging therethrough the hydraulic pressure oil. The conduit means has a plurality of spaced radial openings in an axial alignment. The tilting piston rod is of a cylindrical form, and the conduit means is axially slidably fitted in the tilting piston rod so that a chamber of a variable volume is defined in the partial cylinder by the partial cylinder and the conduit means, and the chamber is allowed to communicate with the interior of the conduit means through the spaced openings while the spaced openings are outside the tilting piston rod. By this arrangement, when the tilting piston rod moves upwardly, the number of the spaced openings of the conduit means, through which the chamber is allowed to communicate with the interior of the conduit means, increases in a case of the lower conduit means, and decreases in a case of the upper conduit means, when the tilting piston rod moves downwardly. The above-mentioned number decreases in a case of the lower conduit means, and increases in a case of the upper conduit means.

BRIEF DESCRIPTION OF THE DRAWINGS

Other features and advantages of the present invention can be more fully understood from the following detailed description with reference to the accompanying drawings in which.

DESCRIPTION OF THE PREFERRED EMBODIMENTS

Figure 1:
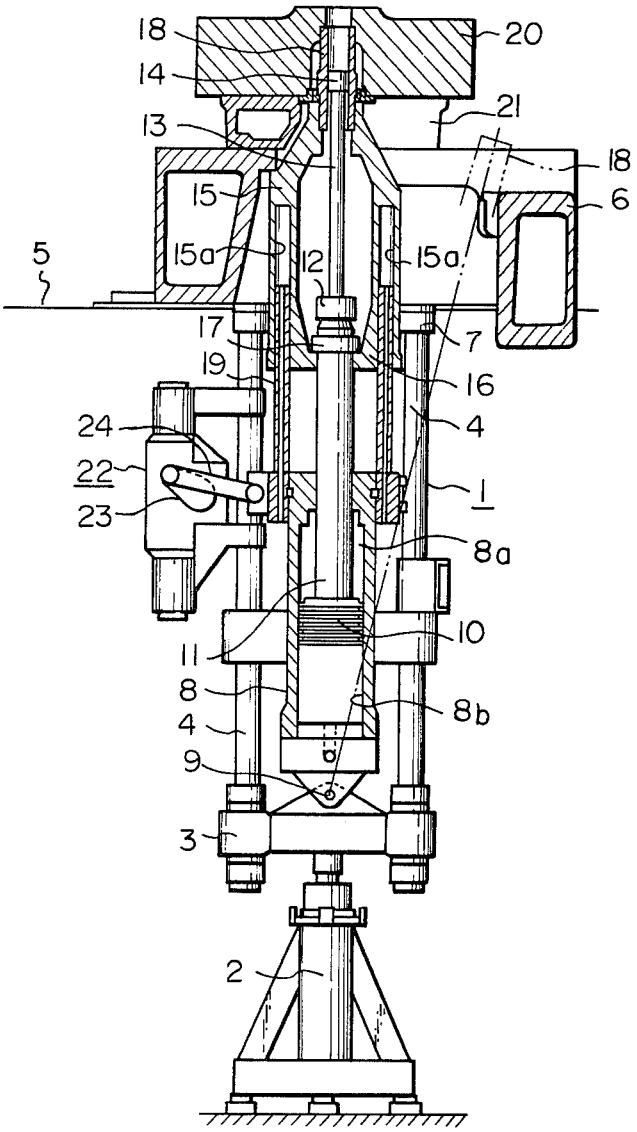
FIG. 1 is a side view illustrating the longitudinal section of the entire structure of an embodiment of the vertical die casting machine according to the present invention.

Referring to FIG. 1, a vertical die casting machine generally represented by reference numeral 1 is constructed with a centering support 2, and a casting cylinder platen 3 is secured to the top of the machine 1 by means of tie rods 4 in an arrangement such that the lower ends of the tie rods 4 are secured to the casting cylinder platen 3 and the upper ends of the tie rods 4 are secured through connection members 7 to a stationary platen 6. The stationary platen 6 is secured to a base stand 5.

In the space defined by the tie rods 4, a hydraulic casting cylinder 8 for actuating a piston 10 is arranged in such manner that the lower end of the casting cylinder 8 is turnably pivoted on the casting cylinder platen 3 through a shaft 9.

The piston 10 is integrated with a piston rod 11, and the upper end of the piston rod 11 is connected to a plunger 13 through a coupling 12. A plunger tip 14 is secured to the upper end of the plunger 13.

Reference numeral 15 denotes a hollow block in which an engaging or restricted portion 16 is formed on the inner side of the lower end portion of the block 15. The top face of this engaging portion 16 is engaged with the periphery of a projection 17. The projection 17 is formed by using a collar or the like on the coupling 12 which is a connection between the piston rod 11 and the plunger 13.

A casting sleeve 18 is attached to the upper end of the block, and the plunger tip 14 is slidably fitted in the casting sleeve 18. When the block 15 is elevated axially, the projection 17 is held by the engaging portion 16 and also the projection 17 is integrally elevated, whereby the plunger tip 14 and the casting sleeve 18 are always raised simultaneously. Of course, the coupling 12 may be utilized as the projection 17.

A cylinder 15*a* for actuating a ram 19, extending in the vertical direction, is formed in the block 15, and the ram 19 is secured to the rod end side of the casting cylinder 8. The top end portion of the ram 19 is slidably fitted in the cylinder 15*a*. An operation oil or hydraulic pressure oil is supplied to the interior of the cylinder 15*a* through the bore of the ram from a hydraulic pressure source not shown in the drawings, so that the block 15 is axially moved upward.

A stationary mold 20 forming a casting die with a movable mold (not shown) is mounted on the stationary platen 6 via a movable bolster 21.

Reference numeral 22 represents a tilting device attached to the tie rod 4, which is provided for tilting the casting cylinder 8 about the shaft 9 by rotating a driving link 23 to move a driven link 24 from the vertical position to the inclined position indicated by a dotted line and for returning the casting cylinder 8 to the vertical position after a molten metal is poured into the casting sleeve 18 at the inclined position.

Figure 2:
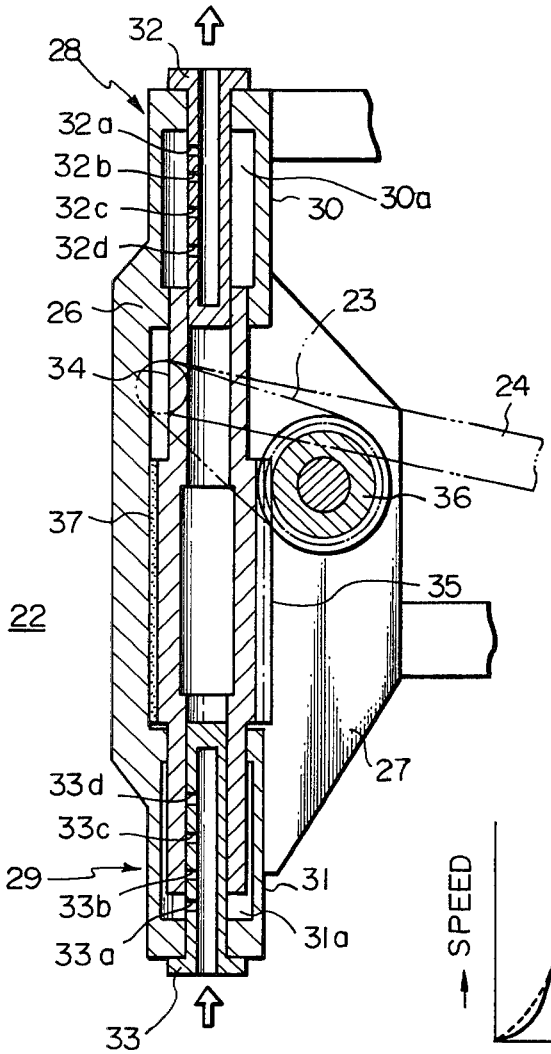
FIG. 2 is a longitudinal sectional view of the tilting device incorporated in the machine shown in FIG. 1.
Figure 3:
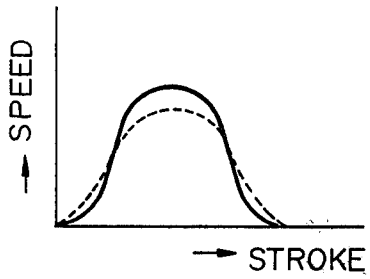
FIG. 3 is a graph illustrating the movement characteristics exhibited by the tilting device illustrated in FIG. 2.

The detail of the tilting device and operation thereof will be described with reference to FIGS. 2 and 3. Referring to FIG. 2, the tilting device 22 is constructed with a frame 26 as a base, which is provided with a bracket 27 as a part of the frame formed integrally therewith. The tilting device 22 has a hydraulic cylinder forming a pair of an upper partial cylinder 30 and a lower partial cylinder 31, which operate in cooperation, for actuating a hollow piston rod 34 having a bore. The pair of partial cylinders 30 and 31 are spaced apart from each other and are supported by the frame 26. The upper and lower portions of the piston rod 34 are slidably fitted in the upper and lower partial cylinders 30 and 31, respectively. Conduits 32 and 33, the interiors of which are communicated with the hydraulic pressure supply source, are concentrically arranged in the upper and lower partial cylinders 30 and 31, and are secured to the lower end of the lower partial cylinder 3 and to the upper end of the upper partial cylinder 30, respectively. The inner end of each conduit is closed. In these conduits, the oil is introduced and discharged through openings 32*a* through 32*d* and 33*a* through 33*d*, designated in order from the outer ends of the conduits 32 and 33, which are formed at the corresponding positions symmetrically in the vertical direction.

The inner ends of the upper and lower conduits 32 and 33 are slidably fitted in the upper and lower ends, respectively, of the hollow piston rod 34 so that the piston rod 34 is allowed to slide in such a manner that the inner surfaces thereof are kept in contact with the outer surfaces of the conduits 32 and 33.

An axial rack gear 35 is mounted in an intermediate portion of the piston rod 34 and is engaged with a pinion gear 36 rotatably pivoted on the bracket 27. One end of the driving link 23 is integrally secured to the pinion gear 36, while the other end of the driving link 23 is rotatably connected to one end of the driven link 24. The other end of the driven link 24 is rotatably pivoted on the side portion of the casting cylinder 8. Between the piston rod 34 and the frame 26, a liner 37 is fixed on the side of the piston rod 34 to guarantee the smooth operation of the piston rod 34.

The operation of the present embodiment having the above-mentioned structure will now be described.

The state indicated by the solid line in FIG. 1 is a state just after the casting operation, in which the plunger tip 14 is retreated axially after casting. For supplying a molten metal into the casting sleeve 18, the operating oil is first supplied to an upper chamber 8*a* on the rod end side of the casting cylinder 8 and, simultaneously, an operating oil discharge outlet of the cylinder 15*a* located on the lower end of the ram 19 is opened. With downward movement of the piston rod 11, the block 15 is simultaneously moved downwardly, since the lower portion of block 15 serves as a stopper against the projection 17. Therefore, the block 15, and hence, the casting sleeve 18 are moved downwardly simultaneously and integrally with the plunger tip 14.

Accordingly, both the plunger tip 14 and the casting sleeve 18 are released from the state of docking in the stationary mold and abutting there-against without any change of the positional relationship between the plunger tip 14 and the casting sleeve 18, and they are shifted vertically below the stationary mold 20. In other words, the axial length of the space defined by the casting sleeve 18 and the plunger tip 14 for the molten metal or melt is maintained constant, irrespective of the movements of the casting sleeve 18 and the plunger tip 14.

In this state, the tilting device 22 is operated as described so that, the driving link 23 rotates the driven link 24, and therefore, the casting cylinder 8, plunger tip 14 and casting sleeve 18 are simultaneously tilted as indicated by a chain line. In this tilted state, the casting sleeve 18 receives a molten metal from a molten metal feed device not shown in the drawings. After termination of supply of the molten metal, the casting cylinder 8, and hence, the casting sleeve 18 and plunger tip 14 are restored to the vertical state before tilting. In the vertical state, means for simultaneous release of the hydraulic pressure in the upper chamber 8*a* on the rod end side of the casting cylinder 8 and in the lower chamber 8*b* on the head end side of the casting cylinder 8 is actuated, and then the hydraulic pressure is applied to the interior of the cylinder 15*a* through the bore of the ram 19. Accordingly, the block 15 is raised up axially and, also, the casting sleeve 18 is raised up, and simultaneously, the plunger tip 14 with the plunger 13 is lifted up since the projection 17 serves as a stopper against the lower portion of the block 15. Therefore, the plunger tip 14 and the casting sleeve 18 are moved upwardly without any change of the positional relationship between the plunger tip and the casting sleeve 18. Thus the state of docking of the casting sleeve 18 in the stationary mold 20 is attained. Consequently, the molten metal is shifted to the position ready for injecton, without any change of the liquid level, and occurrence of such problems as scattering and cooling of the melt is prevented. After abutting of the casting sleeve 18 against the stationary mold 20, under the condition that the movable mold and the stationary mold 20 are in contact so as to define a mold cavity, the operating oil is supplied to the chamber 8*b* on the head end side of the casting cylinder 8 to raise the piston rod 11, and the melt in the space defined by the plunger tip 14 and the casting sleeve 18 is injected into the mold cavity by the plunger 13, thus completing the casting operation. In the above process, the liquid level of the melt in the space is not changed at all, and the melt can be lifted up quietly without causing overflowing of the melt from the casting sleeve 18, cooling of the melt or oxidation of the melt. Therefore, the casting operation can be performed very effectively and advantageously according to the present invention. Furthermore, the plunger tip 14 is prevented from falling out of the casting sleeve 18 during the rising step, and the operation can be performed very safely.

With respect to the tilting device 22, its operation will now be described in detail, with reference to FIGS. 2 and 3.

In the state of the machine as indicated by a solid line in FIG. 1, if an operating oil is supplied to the lower conduit 33 as indicated by a lower axial arrow in FIG. 2, in the tilting device 22, the oil is discharged from the lowest oil opening 33*a* to apply pressure to the lower end of the piston rod 34, whereby the piston rod 34 is elevated axially and the pinion gear 36 engaged with the rack gear 35 is turned clockwise in FIG. 2 to turn the driving link 23 clockwise. Accordingly, the driven link 24 is pushed, toward the casting cylinder 8, with the result that the casting cylinder 8 and the casting sleeve 18 are turned clockwise, as indicated by a chain line in FIG. 1, with the shaft 9 serving as a pivotal axis of the cylinder 8.

In the initial stage of the operation of the piston rod 34, the number of the oil openings of the lower conduit 33 opened, as the piston rod 34 moves upwardly, is small, but the openings 33*b*, 33*c* and 33*d* are gradually opened, in this order, to increase the amount of the oil supplied to the cylinder chamber 31*a*. Accordingly, the piston rod 34 is moved smoothly while increasing the upward speed gradually. Simultaneously, the openings 32*d*, 32*c*, 32*b* and 32*a* of the upper conduit 32 are gradually closed, in this order, beginning with the lowest opening 32*d*, and the amount of the oil discharged from the upper conduit 32 is gradually decreased. Accordingly, in the vicinity of the upper most position of the piston rod 34, the speed of the piston rod 34 is gradually decreased, and finally, the piston rod 34 is gently stopped. In the middle of elevation, the speed of the piston rod 34 is not reduced because each of the oil inlets 33*a* and 33*b*, and the oil outlets 32*a* and 32*b* has a sufficient oil-passing area. Accordingly, the moving speed of the piston rod 34 is gradually changed to produce a relation as illustrated in the graph of FIG. 3 between the moving speed of the piston rod and the stroke thereof. That is, in the initial and final stages of the stroke, the speed is low, and a maximum speed is attained in the middle stage. Thus, a preferable change of the moving speed can be obtained. This speed change is further improved due to the characteristics of the rotary linkage mechanisms 23 and 24 determined by the rack gear 35 and the pinion gear 36, as illustrated by a dotted line in FIG. 3. More specifically, when the casting cylinder 8 begins to tilt, the speed is gradually increased, and approaching the termination of the tilting movement, the speed is gradually reduced. In the intermediate stage, the moving speed is maintained at a high level. Thus, the tilting operation can be performed at the preferable speed and the operational efficiency can be remarkably increased.

When the tilting operation is thus completed, the molten metal is supplied to the casting sleeve 18, as stated before, and then the oil is supplied to the openings of the upper conduit 32 and along the course opposite to the above mentioned course. As a result, the casting sleeve 18 is restored to the vertical position below the stationary mold 20. Also in this case, of course, the casting sleeve 18 and the plunger tip 14 are returned to the original positions at a preferable rate of change of speed simultaneously with the reverse tilting motion of the casting cylinder 8. Therefore, the melt in the casting sleeve 18 is transported smoothly without agitation. Then, at the original vertical position, the oil is supplied into the cylinder 15*a* of the block 15 in the state where the pressure on the chamber 8*a* and 8*b* of the casting cylinder 8 is released to elevate the block 15 as explained before.

As will be apparent from the foregoing illustration, according to the present invention, the tilting operation can be completed in a very short time at high efficiency, and shocks during the tilting movement can be remarkably reduced as compared with shocks produced in a conventional tilting device where the casting cylinder is tilted directly by hydraulic means, and occurrence of problems such as scattering of the melt and oxidation of the melt by the rapid movement of the melt, can be effectively prevented.

Further, it should be noted that, in the present invention, the acceleration and speed reduction characteristics of the tilting piston rod 11 can be freely set by appropriately adjusting the number, diameter and arrangement of oil openings of the upper and lower conduits.

We claim:

1. A vertical die casting machine, comprising:

a stationary platen;

a stationary mold secured to said stationary platen, to define a die cavity, with a movable mold;

a casting sleeve having an upper end for abutting against said stationary mold from below said stationary mold;

a plunger slidably disposed in said casting sleeve, said plunger having a plunger tip at the upper end thereof which defines, with said casting sleeve, a space in said casting sleeve, in which space a molten metal to be injected by said plunger into said die cavity is received;

a hollow block having an axial bore, a lower end portion of said casting sleeve being connected to an upper portion of said block, said plunger extending axially downwardly in the bore of said block, the bore of said block being restricted in a lower portion of said block, and;

a hydraulic casting cylinder, mounted to said stationary platen, for actuating a casting piston rod, said casting piston rod being connected to a lower end of said plunger to form, together with said plunger, a piston extension, said block being mounted to said casting cylinder and including means for an axial movement thereof relative to said cylinder, said piston extension having within the bore of said block a radial projection, whereby the lower portion of said block serves as a stopper against said projection when said casting piston rod moves downwardly and said projection serves as a stopper against the lower portion of said block when said block moves upwardly, so that an axial length of said space for the molten metal is maintained constant regardless of the axial movements of said casting sleeve and said plunger tip.

2. A vertical die casting machine as claimed in claim 1, wherein said block is mounted for an axial movement relative to said casting cylinder by means of a hydraulic ram cylinder.

3. A vertical die casting machine as claimed in claim 2, wherein the ram constituting said ram cylinder is connected to an upper end of said casting cylinder, while the cylinder constituting said ram cylinder is integrated with said block.

4. A vertical die casting machine as claimed in one of claims 2 and 3, wherein: said casting cylinder has upper and lower chambers for a hydraulic pressure oil separated by said casting piston rod and is provided with means for releasing hydraulic pressure from both said chambers when said ram cylinder is actuated to force said block to move upwardly together with said casting sleeve, whereby said piston extension including said casting piston rod and said plunger is lifted up by only said block.

5. A vertical die casting machine as claimed in any one of claims 1 through 3, wherein said casting cylinder is pivotally mounted to said stationary platen so that it is allowed to move from a vertical position to an inclined position when said casting sleeve is in a lower position where the upper abutting end of said casting sleeve is spaced apart downwardly from said stationary mold, and a tilting device is provided for actuating said casting cylinder, while said casting sleeve is located at said lower position, so that said casting sleeve together with said casting cylinder is rotated from said vertical position to said inclined position where the molten metal is supplied to said space defined by said casting sleeve and said plunger tip and then is returned to said vertical position, said tilting device comprising: a hydraulic cylinder, for actuating a tilting piston, consisting of a pair of upper and lower partial cylinders mounted to said stationary platen in such arrangement that said partial cylinders are spaced apart from each other in the axial direction, said tilting piston rod having upper and lower portions axially slidably fitted in said upper and lower partial cylinders, respectively, and having an intermediate portion forming an axial rack gear;

a pinion gear rotatably mounted to said stationary platen in an engagement with said rack gear, and;

a linkage connected to said pinion gear at one end and to said casting cylinder at the other end, wherein: while said upper partial cylinder is released from a hydraulic pressure, said lower partial cylinder is supplied with the hydraulic pressure oil so that said tilting piston rod is forced to move upwardly, and; while said lower partial cylinder is released from the hydraulic pressure, said upper partial cylinder is supplied with the hydraulic pressure oil so that said tilting piston rod is forced to move downwardly.

6. A vertical die casting machine as claimed in claim 5, wherein: said upper and lower partial cylinders are provided with upper and lower conduit means fixed at the upper end of said upper partial cylinder and at the lower end of said lower partial cylinder, respectively, each of said conduit means extending axially in said respective partial cylinders and being open at the outer end thereof for introducing and discharging the hydraulic pressure oil and being closed at the inner end thereof; said conduit means having spaced radial openings in an axial alignment, and; said tilting piston rod is of a cylindrical form, said conduit means being axially slidably fitted in said tilting piston rod so that a chamber in said partial cylinder is defined by the inner walls of said partial cylinder and said conduit means and said chamber is allowed to communicate with the interior of said conduit means through said spaced openings while said spaced openings are outside said tilting piston rod, whereby: the number of said spaced openings of said conduit means through which said chamber communicates with the interior of said conduit means increases in a case of said lower conduit means, and decreases in a case of said upper conduit means, according to said upward movement of said tilting piston rod, and; said number decreases in a case of said lower conduit means, and increases in a case of said upper conduit means, according to said downward movement of said tilting piston rod.

7. A vertical die casting machine comprising:

a stationary platen; a stationary mold secured to said stationary platen; a casting sleeve having an upper end for abutting against said stationary mold from below said stationary mold; a plunger slidably disposed in said casting sleeve, said plunger having a plunger tip which defines, with said casting sleeve, a space in said casting sleeve, in which space a molten metal to be injected by said plunger into said stationary mold is received, and; a hydraulic casting cylinder, mounted to said stationary platen, for actuating a casting piston rod, said casting piston rod being connected to a lower end of said plunger, said casting sleeve being mounted to said casting cylinder an including means for an axial movement thereof relative to said cylinder, said casting cylinder being pivotally mounted to said stationary platen so that it is allowed to move from a vertical position to an inclined position when said casting sleeve is in a lower position where the upper abutting end of said casting sleeve is spaced apart and downwardly from said stationary mold, and; a tilting device provided for actuating said casting cylinder, while said casting sleeve is located at said lower position, so that said casting sleeve together with said casting cylinder is rotated from said vertical position to said inclined position where the molten metal is supplied to said space defined by said casting sleeve and said plunger tip and then is returned to said vertical position, said tilting device comprising: p1 a hydraulic cylinder for actuating a tilting piston, consisting of a pair of upper and lower partial cylinders mounted to said stationary platen in such arrangement that said partial cylinders are spaced apart from each other in the axial direction; said tilting piston rod having upper and lower portions axially slidably fitted in said upper and lower partial cylinders, respectively, and having an intermediate portion forming an axial rack gear;

a pinion gear rotatably mounted to said stationary platen in an engagement with said rack gear, and;

a linkage connected to said pinion gear at its one end and to said casting cylinder at the other end, wherein: while said upper partial cylinder is released from a hydraulic pressure, said lower partial cylinder is supplied with hydraulic pressure oil so that said tilting piston rod is forced to move upwardly, and; while said lower partial cylinder is released from the hydraulic pressure, said upper partial cylinder is supplied with the hydraulic pressure oil so that said tilting piston rod is forced to move downwardly.

8. A vertical die casting machine as claimed in claim 7, wherein: said upper and lower partial cylinders are provided with upper and lower conduit means fixed at the upper end of said upper partial cylinder and at the lower end of said lower partial cylinder, respectively, each of said conduit means extending axially in said respective partial cylinder and being open at the outer end thereof for introducing and discharging the hydraulic pressure oil and being closed at the inner end thereof, said conduit means having spaced radial openings in an axial alignment, and; said tilting piston rod is of a cylindrical form, said conduit means being axially slidably fitted in said tilting piston rod so that a chamber in said partial cylinder is defined by the inner walls of said partial cylinder and said conduit means and said chamber is allowed to communicate with the interior of said conduit means through said spaced openings while said spaced openings are outside said tilting piston rod, whereby: the number of said spaced openings of said conduit means through which said chamber communicate with the interior of said conduit means increases in a case of said lower conduit means, and decreases in a case of said upper conduit means, according to said upward movement of said tilting piston rod, and; said number decreases in a case of said lower conduit means, and increases in a case of said upper conduit means, according to said downward movement of said tilting piston rod.

9. A vertical die casting machine as claimed in claim 8, wherein said linkage comprises a driving link and a driven link, said driving link is integrally secured to said pinion gear at one end, while it is rotatably connected at the other end to an end of said driven link, and said driven link is rotatably pivoted at its other end on the side portion of said casting cylinder.

10. A vertical die casting machine as claimed in claim 9, wherein said tilting cylinder is mounted to said stationary platen by means of a frame extended therefrom and said tilting piston rod has a liner on a side surface of said intermediate position facing said frame and opposite to the other side thereof where said rack gear is formed, and said casting cylinder is pivotably connected to said frame.

* * * * *

UNITED STATES PATENT AND TRADEMARK OFFICE

CERTIFICATE OF CORRECTION

PATENT NO. : 4,287,935

DATED : September 8, 1981

INVENTOR(S) : Toyoaki Ueno, et al

It is certified that error appears in the above—identified patent and that said Letters Patent is hereby corrected as shown below:

Column 4, line 63: "3" should be --31--.

Column 9, line 59: delete "pl".

Signed and Sealed this

*Eighth* Day of *February 1983*

[SEAL]

*Attest:*

GERALD J. MOSSINGHOFF

*Attesting Officer*

*Commissioner of Patents and Trademarks*